US008936428B1

(12) United States Patent
Page

(10) Patent No.: US 8,936,428 B1
(45) Date of Patent: Jan. 20, 2015

(54) BUCKET MOUNTING SYSTEM

(76) Inventor: James H. Page, Bottineau, ND (US)

( * ) Notice: Subject to any disclaimer, the term of this patent is extended or adjusted under 35 U.S.C. 154(b) by 106 days.

(21) Appl. No.: 13/597,774

(22) Filed: Aug. 29, 2012

(51) Int. Cl.
*B66F 9/18* (2006.01)
*E02F 3/36* (2006.01)
*B66F 9/12* (2006.01)

(52) U.S. Cl.
CPC ... *B66F 9/18* (2013.01); *E02F 3/36* (2013.01); *B66F 9/12* (2013.01); *Y10S 414/125* (2013.01); *Y10S 414/133* (2013.01)
USPC ..... 414/607; 414/912; 414/920; 37/403

(58) Field of Classification Search
CPC ..... E02F 3/3622; E02F 3/3627; E02F 3/3631; E02F 3/3663; E02F 3/3672; B66F 9/12; B66F 9/18
USPC ..... 414/607, 685, 722, 723, 912, 785; 37/403; 172/245, 246, 372, 239, 484, 172/646, 707, 741; 403/321, 355
See application file for complete search history.

(56) References Cited

U.S. PATENT DOCUMENTS

| | | | | |
|---|---|---|---|---|
| 4,106,645 | A * | 8/1978 | Janish | 414/723 |
| 4,616,712 | A * | 10/1986 | Jorgensen | 172/6 |
| 6,168,369 | B1 * | 1/2001 | Bright et al. | 414/724 |
| 2006/0288616 | A1 * | 12/2006 | Strait | 37/231 |

* cited by examiner

*Primary Examiner* — Saul Rodriguez
*Assistant Examiner* — Ronald Jarrett
(74) *Attorney, Agent, or Firm* — Neustel Law Offices

(57) ABSTRACT

A bucket mounting system for efficiently attaching and removing a bucket attachment to a variety of different vehicles. The bucket mounting system generally includes a bucket configured with a pair of mounting bars extending parallel with respect to each other across the rear surface of the bucket. A pair of mounting brackets are provided which may be secured to the mounting bars via use of a pair of U-shaped locking members. Thus, the mounting brackets may be removably secured in a variety of positions on the rear face of the bucket to allow its mounting on a wide range of different vehicles such as loaders.

10 Claims, 5 Drawing Sheets

BUCKET MOUNTING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a mounting system for buckets and more specifically it relates to a bucket mounting system for efficiently attaching and removing a bucket attachment to a variety of different vehicles.

2. Description of the Related Art

Any discussion of the related art throughout the specification should in no way be considered as an admission that such related art is widely known or forms part of common general knowledge in the field.

Buckets of various types have been in use for decades in harvesting crops, scooping dirt, conveying goods and the like. In the past, buckets have generally been adapted for use with a specific type of vehicle or loader. Thus, when a loader or vehicle is replaced, it is often necessary to also purchase a new bucket.

Further, where an individual utilizes multiple loaders or vehicles, multiple buckets are often needed. Such pre-existing systems often cost more due to the necessity of owning multiple buckets. Further, the storage of multiple buckets often takes up a considerable amount of space.

Because of the inherent problems with the related art, there is a need for a new and improved bucket mounting system for efficiently attaching and removing a bucket attachment to a variety of different vehicles.

BRIEF SUMMARY OF THE INVENTION

The invention generally relates to a bucket mounting system which includes a bucket configured with a pair of mounting bars extending parallel with respect to each other across the rear surface of the bucket. A pair of mounting brackets are provided which may be secured to the mounting bars via use of a pair of U-shaped locking members. Thus, the mounting brackets may be removably secured in a variety of positions on the rear face of the bucket to allow its mounting on a wide range of different vehicles such as loaders.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
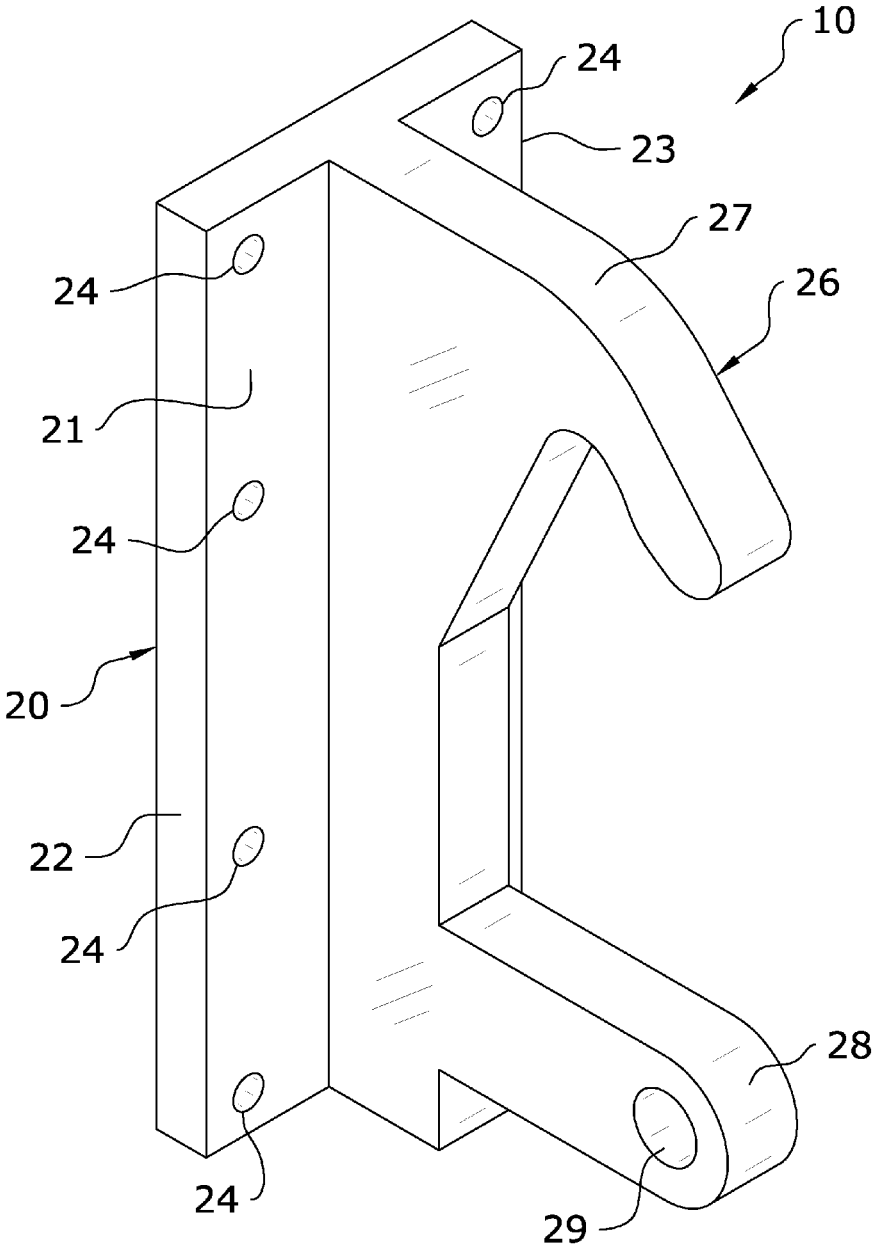
FIG. 1 is a frontal upper perspective view of the mounting bracket of the present invention.

Turning now descriptively to the drawings, in which similar reference characters denote similar elements throughout the several views, FIGS. 1 through 5*b* illustrate a bucket mounting system 10, which comprises a bucket 11 configured with a pair of mounting bars 14, 15 extending parallel with respect to each other across the rear surface 12 of the bucket 11. A pair of mounting brackets 20 are provided which may be secured to the mounting bars 14, 15 via use of a pair of U-shaped locking members 30, 32. Thus, the mounting brackets 20 may be removably secured in a variety of positions on the rear face 12 of the bucket 11 to allow its mounting on a wide range of different vehicles such as loaders.

B. Bucket

The present invention is adapted for use in securing a bucket 11 to a vehicle such as a loader, skid steer or the like. While the exemplary figures illustrate a harvesting bucket with auger, it is appreciated that the present invention may be utilized in combination with a wide variety of bucket 11 designs. Thus, the scope of the present invention should not be construed as being limited by the exemplary figures.

Figure 3:
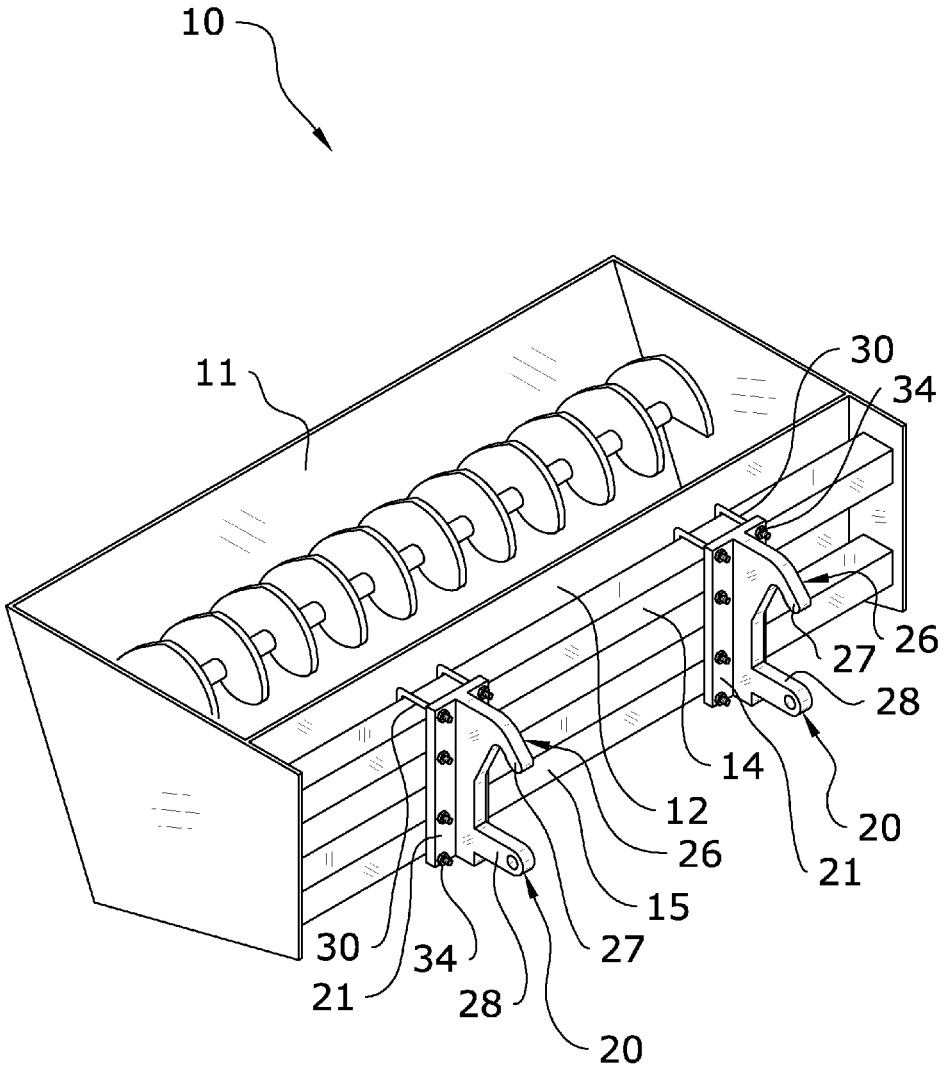
FIG. 3 is a rear upper perspective view of the present invention.

As shown in FIG. 3, the rear face 12 of the bucket 11 generally includes a pair of mounting bars 14, 15. A first mounting bar 14 extends across the rear face 12 of the bucket 11 and a second mounting bar 15 extends parallel with respect to said first mounting bar 14 in a vertically offset position. The mounting bars 14, 15 are utilized as mounting points for the mounting brackets 20 of the present invention.

C. Mounting Brackets

Figure 2:
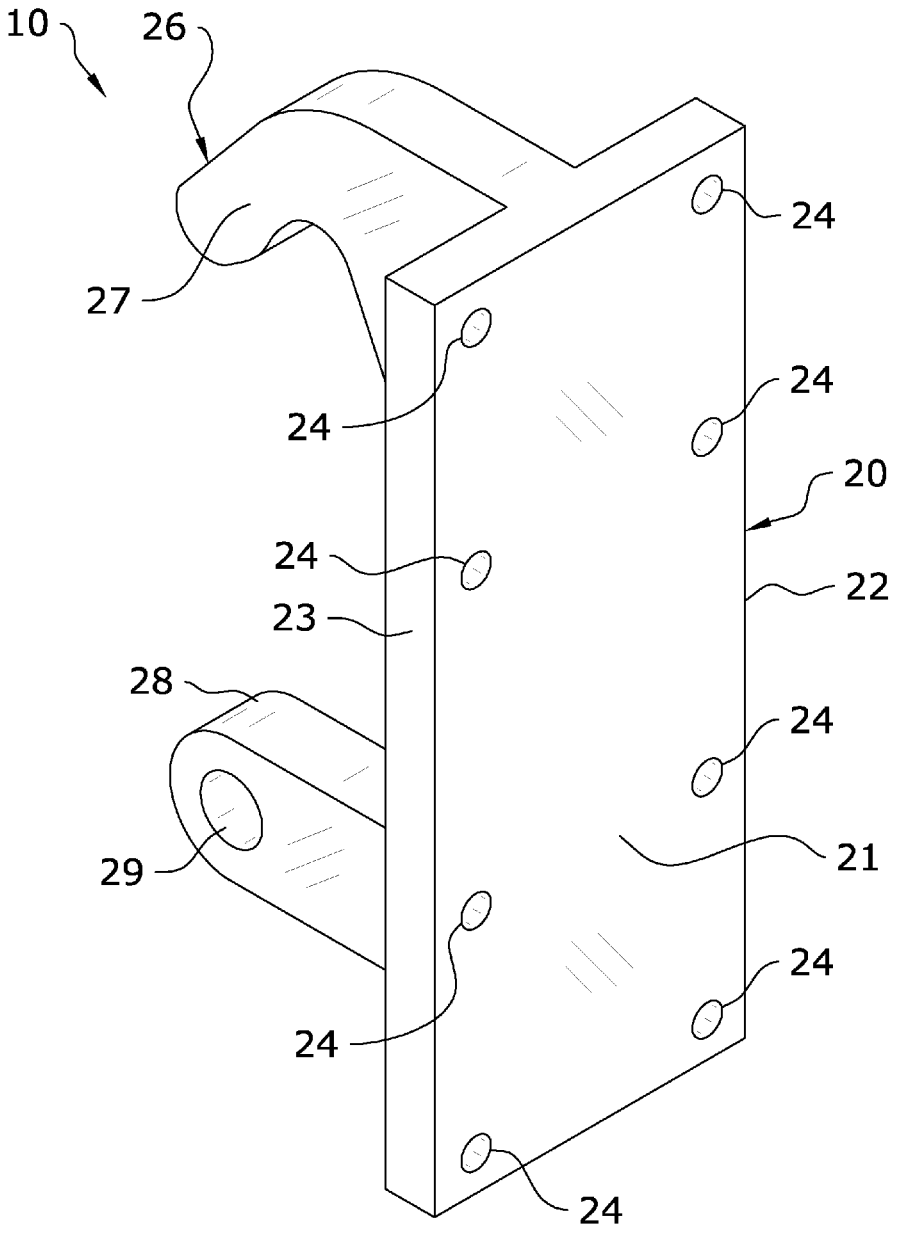
FIG. 2 is a rear upper perspective view of the mounting bracket of the present invention.

As shown in FIGS. 1 and 2, the present invention generally includes at least two mounting brackets 20 which may be slidably and removably secured to the bucket 11 via the mounting bars 14, 15 so that the bucket 11 may be secured to a wide range of vehicles.

Each of the mounting brackets 20 includes a base portion 21 for securing against the mounting bars 14, 15 and a securing portion 26 for securing the bucket 11 to the vehicle. The base portion 21 is generally comprised of a plate member which includes a plurality of apertures 24 extending vertically along its first side 22 and second side 23, through which the fasteners 34 of the present invention will extend to secure the mounting brackets 20 to the mounting bars 14, 15. It is appreciated that the numbering and orientation of the apertures 24 may vary for different applications of the present invention.

The securing portion 26 of each mounting bracket 20 extends outwardly from the base portion 21. As shown in FIG. 1, the securing portion 26 is generally comprised of a first grip 27 extending from a point adjacent an upper end of the base portion 21 and a second grip 28 extending from a point adjacent a lower end of the base portion 21 below the first grip 27. The grips 27, 28 are utilized to secure the bucket 11 to the vehicle.

The first grip 27 is comprised of a curved configuration in which its distal end points downward. The second grip 28 extends horizontally out from the base portion 21 and generally includes a grip aperture 29 positioned at its distal end as shown in FIG. 1. The grip aperture 29 is utilized to secure the mounting bracket 20 to the vehicle.

D. Locking Members

Figure 4:
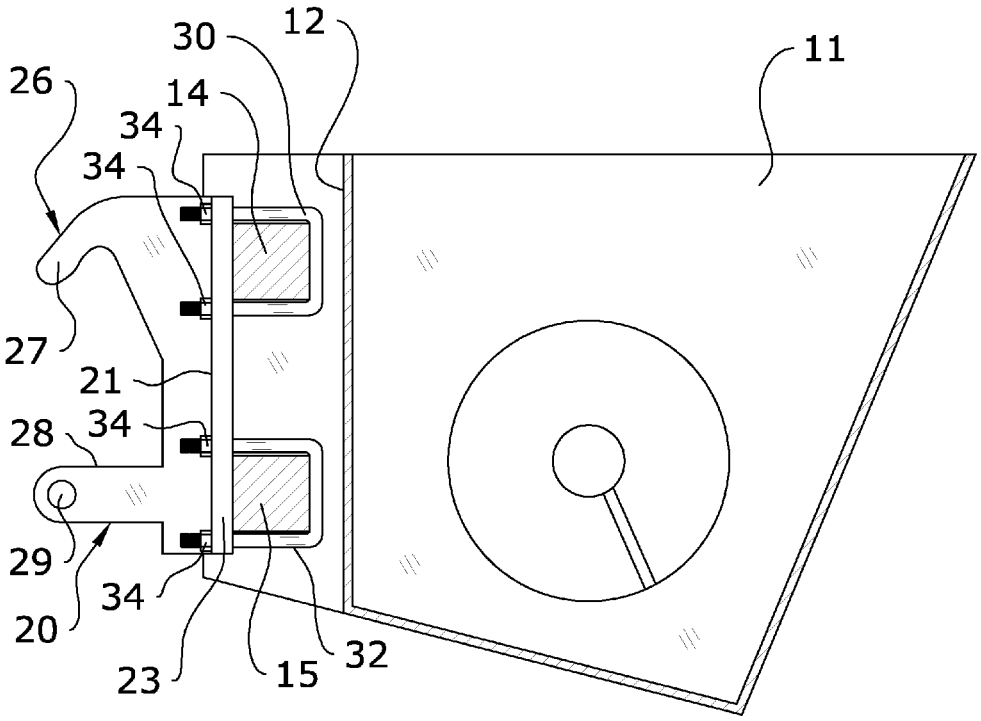
FIG. 4 is a side sectional view of the present invention.

As shown in FIGS. 3 and 4, the present invention includes a pair of locking members 30, 32 which secure the mounting brackets 20 to the mounting bars 14, 15. Generally, a pair of locking members 30, 32 is utilized for each mounting bracket 20, with a first locking member 30 extending around the first mounting bar 14 of the bucket 11 and a second locking member 32 extending around the second mounting bar 15 of the bucket 11.

Each locking member 30, 32 is comprised of a U-shaped member which extends around the mounting bars 14, 15. Each locking member 30, 32 is secured to the base portion 21 of the mounting bracket 20 via one or more fasteners 34 extending through the apertures 24 of the base portion 21 as shown in FIG. 4.

E. Operation of Preferred Embodiment

Figure 5A:
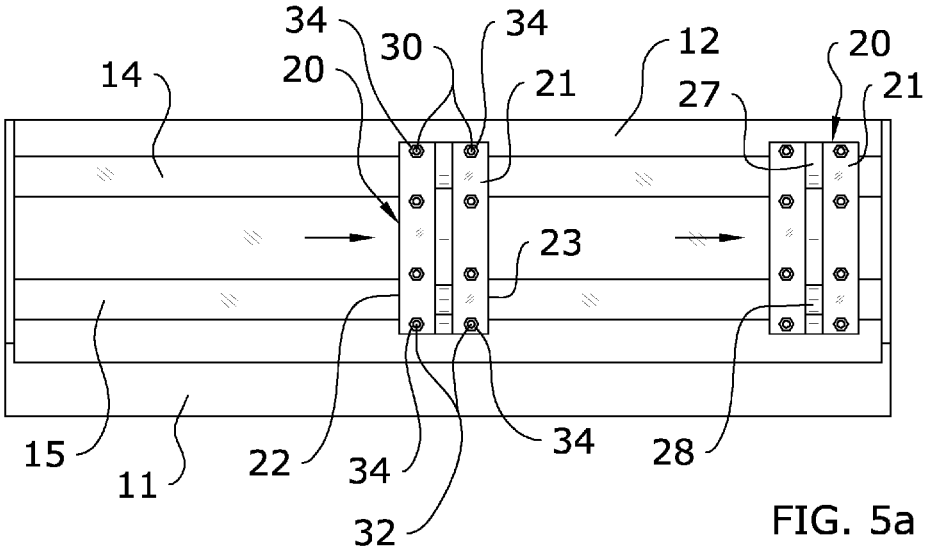
FIG. 5*a* is a rear view of the present invention in a first position.
Figure 5B:
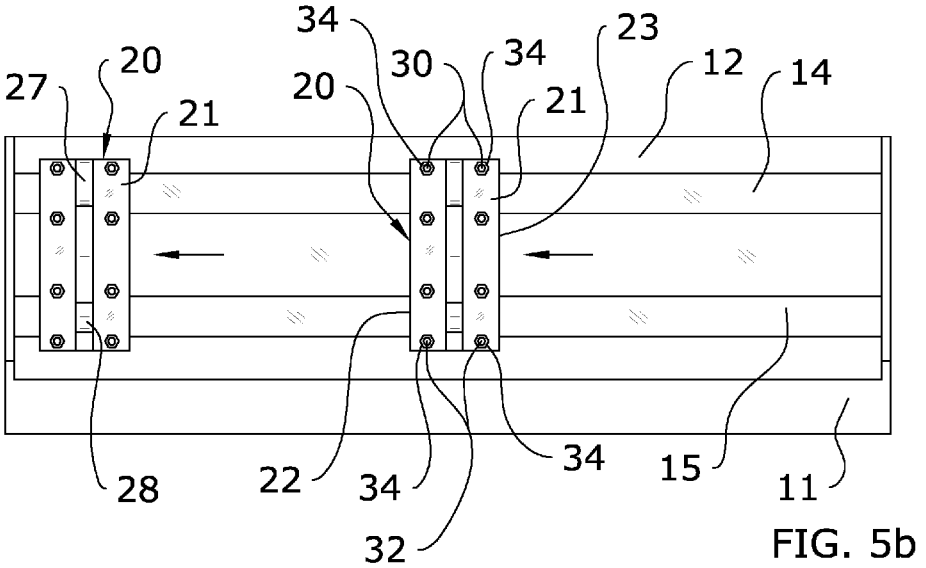
FIG. 5*b* is a rear view of the present invention in a second position.

In use, the mounting brackets 20 are first secured to the mounting bars 14, 15 of the bucket 11. As shown in FIGS. 5*a* and 5*b*, the positioning of the mounting brackets 20 may vary to suit different vehicles. The mounting brackets 20 are secured to the mounting bars 14, 15 via use of a pair of locking members 30, 32 which extend around the bars 14, 15 and are secured to the base portion 21 of the mounting brackets 20 via fasteners 34. The grips 27, 28 and grip aperture 29 may then be utilized to secure the bucket 11 to the vehicle.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A bucket mounting system, comprising:

a bucket;

a first mounting bar extending horizontally across a rear end of said bucket, said first mounting bar extending between a first side of said bucket and a second side of said bucket;

a second mounting bar extending parallel with respect to said first mounting bar, said second mounting bar extending between a first side of said bucket and a second side of said bucket;

a first mounting bracket adapted to securely attach to a vehicle, wherein said first mounting bracket is slidably mounted to said first mounting bar and said second mounting bar, said first mounting bracket being freely slidable between said first end and said second end of said bucket;

a second mounting bracket adapted to securely attach to a vehicle, wherein said second mounting bracket is slidably mounted to said first mounting bar and said second mounting bar, said second mounting bracket being freely slidable between said first end and said second end of said bucket; and a plurality of locking members for removably securing said first mounting bracket and said second mounting bracket to said mounting bars, each of said plurality of locking members being comprised of a U-shape.

2. The bucket mounting system of claim 1, wherein said bucket is comprised of a scooping bucket.

3. The bucket mounting system of claim 1, wherein said first mounting bracket is comprised of a base portion and a securing portion extending from said base portion.

4. The bucket mounting system of claim 3, wherein said second mounting bracket is comprised of a base portion and a securing portion extending from said base portion.

5. The bucket mounting system of claim 4, wherein said securing portion of said first mounting bracket is comprised of a first grip and a second grip.

6. The bucket mounting system of claim 5, wherein said first grip extends diagonally and wherein said second grip extends horizontally.

7. The bucket mounting system of claim 3, wherein said base portion of said first mounting bracket includes a first plurality of apertures extending vertically along a first side thereof and a second plurality of apertures extending vertically along a second side thereof.

8. The bucket mounting system of claim 7, wherein said base portion of said second mounting bracket includes a first plurality of apertures extending vertically along a first side thereof and a second plurality of apertures extending vertically along a second side thereof.

9. The bucket mounting system of claim 1, wherein said first mounting bar and said second mounting bar extend parallel with respect to each other.

10. The bucket mounting system of claim 1, wherein said vehicle is comprised of a loader.

* * * * *